US005898998A

United States Patent [19]

Devillé

[11] Patent Number: 5,898,998

[45] Date of Patent: May 4, 1999

[54] BOLT-CUTTER TYPE CUTTING TOOL

[75] Inventor: Antoine Devillé, Baugé, France

[73] Assignee: Deville SA Secateurs Pradines, Bauge, France

[21] Appl. No.: 08/805,648

[22] Filed: Feb. 27, 1997

[30] Foreign Application Priority Data

Mar. 1, 1996 [FR] France ..... 96 02631

[51] Int. Cl.[6] ..... B26B 17/02

[52] U.S. Cl. ..... 30/193; 30/252

[58] Field of Search ..... 30/175–181, 186–193, 30/252, 245; 81/418, 387

[56] References Cited

U.S. PATENT DOCUMENTS

| | | | |
|---|---|---|---|
| 1,760,627 | 5/1930 | Bernard | 30/192 |
| 4,353,240 | 10/1982 | Undin et al. | 81/418 X |
| 5,245,755 | 9/1993 | Krivec | 30/189 |

FOREIGN PATENT DOCUMENTS

| | | | |
|---|---|---|---|
| 0116711 | 8/1984 | European Pat. Off. . | |
| 483786 | 8/1917 | France | 30/193 |
| 528062 | 11/1921 | France | 30/192 |
| 1257134 | 2/1961 | France . | |
| G92035914 | 6/1992 | Germany . | |
| 444927 | 3/1936 | United Kingdom . | |
| 1139784 | 1/1969 | United Kingdom . | |

OTHER PUBLICATIONS

Rapport De Recherche Preliminaire (Preliminary Search Report) FA 525402 FR 9602631.

*Primary Examiner*—Douglas D. Watts
*Attorney, Agent, or Firm*—Young & Basile, P.C.

[57] ABSTRACT

A bolt-cutter type cutting tool has two blade supports each mounted to pivot about a respective pin carried by at least one spacer member of the tool and each having at the free end of its inside edge a removable cutting blade. Each blade support comprises two parallel support members fastened to each other and between which is disposed a central spacer member carrying the pivot pins.

10 Claims, 2 Drawing Sheets

BOLT-CUTTER TYPE CUTTING TOOL

BACKGROUND OF THE INVENTION

1. Field of the invention

The present invention concerns a bolt-cutter type cutting tool.

2. Description of the prior art

Many bolt-cutter type cutting tools are known in themselves. In a manner that is known in itself, a tool of this kind comprises two blade supports each of which is mounted to pivot about a respective pin carried by at least one spacer member of the tool and carries at the free end of its inside edge a removable cutting blade having an interior cutting edge facing the interior cutting edge of the other cutting blade, the tool further including means for pivoting the two blade supports about their respective pivot pins in opposite directions so as to move the two cutting edges towards each other in order to cut a metal member such as a bolt.

To enable it to withstand the forces that are generated during cutting, each blade support is forged and then subjected to appropriate heat treatment. The unit cost of a blade support of this kind is therefore high. The removable cutting blade may be made from a costly noble material, such as high speed steel or tungsten carbide, for example. In one embodiment known in itself the blade has a substantially triangular cross-section and can be fixed to the support by each of its faces in succession to enable the use of the opposite cutting edge. The blade is fixed to its support by devices such as claws which may constitute a weakness of the tool.

In an embodiment that is less costly but offers a lower level of performance, the blade is in one piece with the blade support which is forged and then quenched. The cutting edge is straightened, for example, in order to penetrate better into the metal to be cut and is subjected to a medium-frequency second quench to impart a very high hardness to the cutting surface.

In all cases, the manufacture of the blade support by forging, various heat treatments and quenching is very costly.

The aim of the present invention is to remedy the drawbacks of prior art bolt-cutters and propose a cutting tool of the aforementioned type having a structure that enables it to be manufactured and assembled in a particular economical way that can be used both for a relatively low cost tool of moderate quality and for a more costly high-performance and reliable tool.

SUMMARY OF THE INVENTION

The invention consists in a bolt-cutter type cutting tool having two blade supports each mounted to pivot about a respective pin carried by at least one spacer member of said tool and each having at the free end of its inside edge a removable cutting blade having an inside cutting edge facing the inside cutting edge of the other cutting blade, said tool further comprising means for pivoting said two blade supports about their respective pivot pins in opposite directions so as to move said two cutting edges towards each other in order to cut a metal member such as a bolt, each blade support comprising two parallel support members fastened to each other and between which is disposed a central spacer member carrying said pivot pins.

Because of this construction, each of the two parallel support members is subjected to substantially only half of the forces generated during cutting. These support members can therefore have a limited thickness compatible with the capacity of a conventional blanking press. The support members can therefore be cut from metal plate in the press at a unit cost very much lower than that of manufacture by forging.

Moreover, the tolerances obtained on cutting metal plate in a blanking press by stamping followed by reboring punching, even if they are significantly lower than those obtained by forging and machining, are nevertheless compatible with the tolerances required for the manufacture of a cutting tool.

The simple and relatively low cost structure obtained in this way can utilize blades of various qualities at different price levels. It can therefore be used equally well for cutting tools of ordinary quality, equipped with blades made from a relatively low performance and low cost material, and for high performance tools with blades made from a very high performance and relatively costly material, such as tungsten carbide.

Pivoting of the two support members is guided by the central spacer member, which makes the cutting tool of the invention reliable.

In one beneficial version of the invention, each cutting blade has on each of its lateral faces a shoulder forming a bearing surface facing towards the rear of the blade and adapted to bear against a corresponding conjugate bearing surface of each support member.

This assures efficient transmission of cutting forces from the blade to the two support members.

In an advantageous version of the invention, each cutting blade has between the two shoulders a central part extending towards the rear of the blade and adapted to be inserted between the corresponding two support members.

In a preferred version of the invention, each cutting blade is fixed to the corresponding two support members by a pin member passing through two coaxial holes in the respective support members and a hole formed in the central rear part of the cutting blade. This hole through said central rear part of the cutting blade is slightly offset towards the front of the blade relative to the coaxial holes through the respective support members when the blade is in bearing engagement with the bearing surfaces of the two support members, the pin member being a spring pin.

A spring pin of this kind is able to accommodate this offset and to exert a spring force towards the rear of the blade to press the bearing surfaces of the latter strongly against the conjugate bearing surfaces of the two support members.

Other features and advantages of the invention will emerge from the following detailed description.

BRIEF DESCRIPTION OF THE DRAWINGS

In the accompanying drawings, which are given by way of non-limiting example only.

DETAILED DESCRIPTION OF THE PREFERRED EMBODIMENTS

Figure 1:
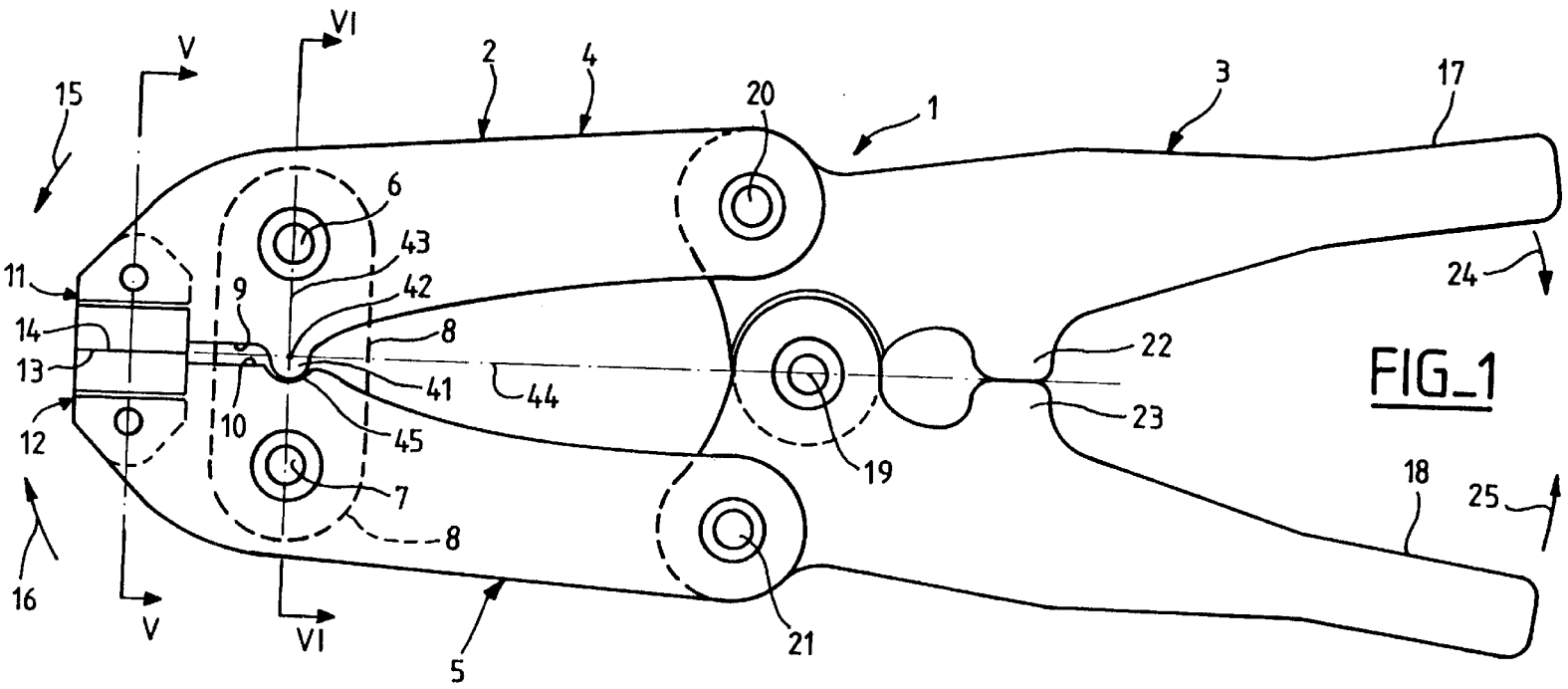
FIG. 1 is an elevation view of one embodiment of a cutting tool in accordance with the present invention.

In the FIG. 1 embodiment, the bolt-cutter type cutting tool 1 has a cutting head 2 and an operating system 3.

The cutting head 2 includes two blade supports 4, 5 each of which pivots about a respective pin 6, 7 carried by a spacer member 8 of the tool 1.

The blade support 4 in the upper part of the figure carries at the free end of its inside edge 9, adjacent the blade support 5, a removable cutting blade 11 having an inside cutting edge 13.

Similarly, the blade support 5 in the lower part of the figure carries at the free end of its inside edge 10, adjacent the blade support 4, a removable cutting blade 12 having an inside cutting edge 14 facing the inside cutting edge 13 of the cutting blade 11. As best illustrated in FIGS. 3–6 and 7, each cutting blade defines a wedge-shaped cutting edge extending along the inside edge of the corresponding support member to which it is mounted.

The cutting tool 1 further includes means for pivoting the two blade supports 4, 5 about their respective pivot pins 6, 7 in opposite directions shown by the arrows 15 and 16 so as to move the two cutting edges 13, 14 towards each other to cut a metal member such as a bolt, not shown.

In the conventional manner, the operating system 3 comprises two operating arms 17, 18 hinged together by a common pin 19. The arms 17, 18 have a predetermined width dependent on the required length of the lever arm to obtain the required cutting power and capacity.

The arm 17 is pivotally connected at 20 to the rear end of the blade support 4. The operating arm 18 is pivotally connected at 21 to the rear end of the blade support 5.

In a manner that is known in itself, the pins 20, 21 are on the opposite side of the pin 19 relative to the operating arms 17, 18 and at a small distance from the pin 19 to obtain the maximum leverage.

The pins 19, 20, 21 are shown in the form of bolts in the figures, like the pins 6 and 7, but could be of any other form known in itself.

The operating arms 17, 18 each have a respective boss 22, 23 projecting towards the other arm. The bosses 22, 23 are designed to be in contact with each other in the closed position of the cutting tool 1 shown in the figure, the cutting edges 13, 14 of the blades 11, 12 remaining separated from each other by a small clearance in the order of 0.5 mm. This prevents damage to the cutting edges 13, 14 and does not in any way make the cutting tool 1 less effective since it is known that, at the end of the operation to cut a metal member such as a bolt or a concrete reinforcing rod, the central part of the member to be cut is not cut by the cutting edges 13, 14 but rather ruptures suddenly as the result of stretching due to the wedging effect brought about by the penetration of the blades into the mass of metal.

In the conventional way, when the two operating arms 17, 18 are moved towards each other (arrows 24, 25), the pivot pins 20, 21 carried by the respective rear ends of the blade supports 4, 5 are moved apart, the supports in turn pivoting about their respective pins 6, 7 to move the cutting edges 13, 14 of the blades 11, 12 towards each other.

On the other hand, if the operating arms 17, 18 are moved away from each other, the cutting edges 13, 14 are moved away from each other.

Figure 4:
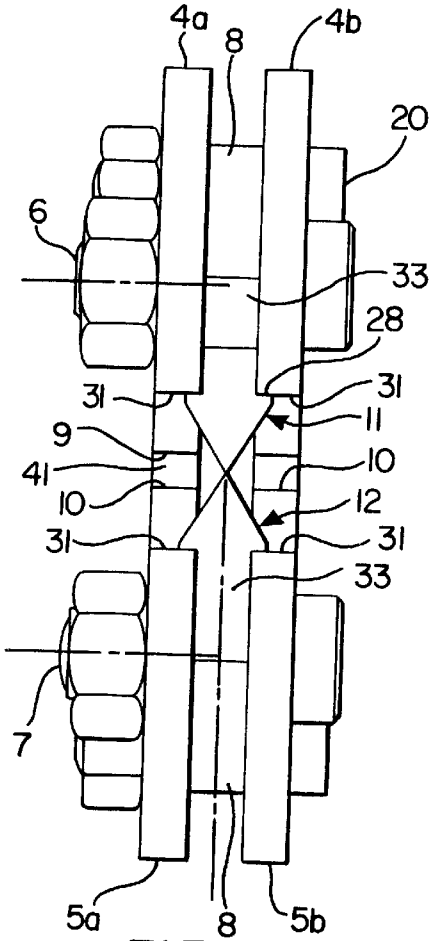
FIG. 4 is a view of the cutting tool from FIG. 1 to a larger scale and as seen from the lefthand side.
Figure 5:
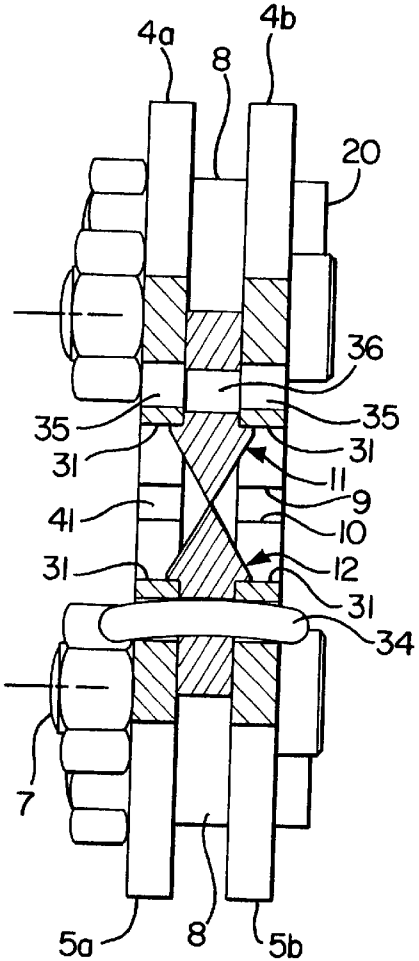
FIG. 5 is a view to a larger scale taken in section along the line V—V in FIG. 1.
Figure 6:
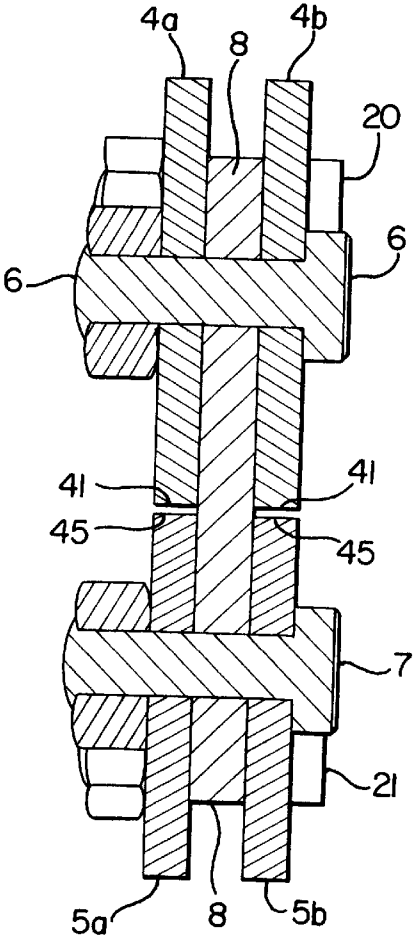
FIG. 6 is a view to a larger scale taken in section along the line VI—VI in FIG. 1.

In accordance with the invention, and as shown in detail in FIGS. 4, 5 and 6, each blade support 4, 5 comprises two respective parallel support members 4*a* and 4*b*, 5*a* and 5*b* that are fastened to each other and between which is disposed the central spacer member 8 carrying the pivot pins 6 and 7.

The two support members 4*a* and 4*b* or 5*a* and 5*b* are therefore joined together at the pin 6, at the pin 20 or 21 and, as will emerge below, at the blade 11 or 12. They therefore constitute a rigid blade support. Under these conditions, the thickness of each support member 4*a*, 4*b* or 5*a*, 5*b* can be significantly less than the thickness of a single blade support, and therefore limited to a thickness in the order of 6 mm to 8 mm (rather than 11 mm or 12 mm), which is compatible with the manufacture of these support members 4*a*, 4*b* or 5*a*, 5*b* by cutting them from a metal plate of this thickness in a press. The manufacturing cost of these support members 4*a*, 4*b* or 5*a*, 5*b* is therefore very much less than that of a single blade support made in the conventional way by forging.

As shown in detail in FIGS. 2 through 5, each cutting blade 11, 12 has on each of its lateral faces 26 a shoulder 28 forming a bearing surface facing towards the rear 30 of the blade and adapted to bear against a corresponding conjugate bearing surface 31 of each support member 4*a*, 4*b*, 5*a*, 5*b*.

In the embodiment shown each cutting blade 11, 12 has between the two shoulders 28 a central part 33 extending towards the rear 30 of the blade and adapted to be inserted between the corresponding two support members 4*a*, 4*b* or 5*a*, 5*b*.

Each cutting blade 11, 12 is fixed to the corresponding two support members 4*a*, 4*b* or 5*a*, 5*b* by a pin member 34 passing through two coaxial holes 35 in the respective support members and a hole 36 in the central rear part 33 of the cutting blade 11, 12 (see FIG. 5).

In the FIG. 5 embodiment, the hole 36 in the central rear part 33 of the blade 11, 12 is slightly offset towards the cutting edge 13, 14 at the front of the blade relative to the coaxial holes 35 when the blade 11, 12 is in bearing engagement with the bearing surfaces 31 of the corresponding two support members. Furthermore, the pin member 34 is a spring pin of any commercially available type known in itself. For example, the pin 34 is a pin made by rolling spring steel upon itself, as manufactured by SPIROL, for example.

Under these conditions, the pin 34, which bears against the edges of the holes 35, exerts an elastic force towards the rear of each blade and presses the shoulders 28 of each blade elastically against the conjugate bearing surfaces 31 of the corresponding support members 4*a*, 4*b* or 5*a*, 5*b*. This holds each blade firmly in the optimal working position.

Figure 2:
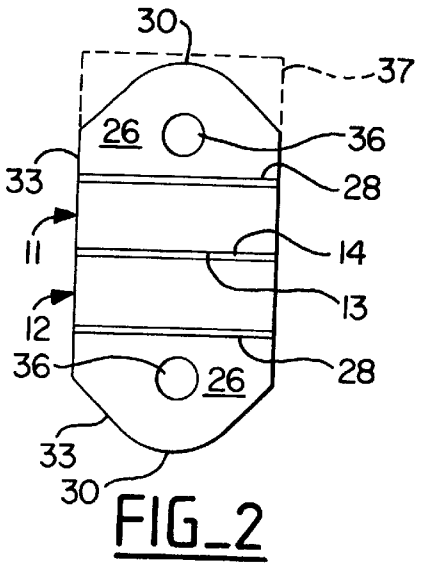
FIG. 2 is a view of part of FIG. 1 to a larger scale, showing the two cutting blades of the tool.
Figure 3:
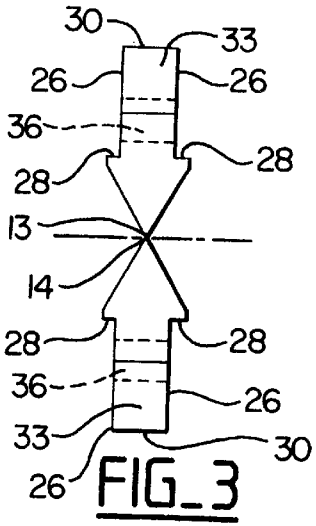
FIG. 3 is a view of the cutting blades as seen from the lefthand side of FIG. 2.

In the embodiment shown in detail in FIGS. 2 and 3, each blade 11, 12 has two planes of symmetry, namely the median plane perpendicular to the plane of FIG. 2 and the median plane perpendicular to the plane of FIG. 3. Each blade 11, 12 is therefore shaped so that it can be replaced after turning it 180°, which is a simple matter given the method of fixing each blade described hereinabove, and extends the service life of the blade.

Figure 7:
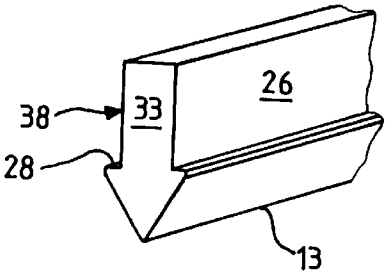
FIG. 7 is a diagrammatic perspective view of a bar from which a cutting blade of the tool from FIG. 1 may be cut.

The shape shown in FIG. 2 of the central rear part 33 of each blade 11, 12 is adapted to be cut out in a press from a blank 37 which may itself be cut to length from a bar 38 having a cross-section the shape of the blank 37 of the blade, as shown diagrammatically in FIG. 7.

This method may be beneficial in that it is known how to make a bar 38 of this kind from high speed steel or from tungsten carbide, in the latter case by hot isostatic compression of carbide powder. The bar 38 obtained has dimensional tolerances that are acceptable for the manufacture of a bolt-cutter type cutting tool.

As shown in the figures, each of the two support members 4*a*, 4*b* of the blade support 4 has on its inside edge 9 a protuberance 41 with a semi-circular convex exterior contour the center 42 of which is located, in the closed position of the tool 1 shown in FIG. 1, and projected into the plane of the figure which is parallel to the surfaces of the support members 4*a*, 4*b*, at the point where the straight line segment 43 joining the respective pivot pins 6 and 7 of the blade supports 4, 5 intersects the median plane 44 of said pins 6, 7.

Each of the support members 5*a*, 5*b* of the other blade support 5 has on its inside edge 10 a semi-circular contour concave notch 45 having in the closed position of the tool 1 the same center 42 as the convex contour of the protuberance 41 and a radius slightly greater than the radius of said convex contour.

It will be understood that each protuberance 41 constitutes along with the corresponding notch 45, the equivalent of a rack that facilitates the operation of the cutting tool 1 without in any way impeding its operation.

Figure 8:
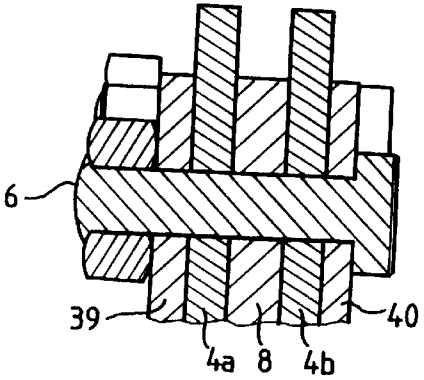
FIG. 8 is a partial view similar to FIG. 6 representing a different embodiment of the present invention.

In the FIG. 8 embodiment, the cutting tool further includes two lateral spacer members 39, 40 parallel to the central spacer member 8 and each support member 4*a*, 4*b* is disposed between the central spacer member 8 and the corresponding lateral spacer member 39, 40.

Thus there has been described and shown a bolt-cutter type cutting tool structure enabling the manufacture of a tool of relatively low cost whilst having the strength and stiffness characteristics required for reliable operation of the tool. A structure of this kind may be fitted with blades of ordinary quality to produce a tool of ordinary quality and of relatively low cost. The same structure may be provided with blades of a much more costly material offering much higher performance, such as tungsten carbide, to constitute a high performance, reliable and durable tool.

Of course, the present invention is not limited to the embodiments just described and many changes and modifications may be made to the latter without departing from the scope of the invention.

For example the shape of the blades 11, 12 and that of the means 28 through which each blade bears on the support members may be modified.

There is claimed:

1. A bolt-cutter type cutting tool having two blade supports each mounted to pivot about a respective one of two pivot pins carried by at least one spacer member of said tool, a first one of said blade supports having at the free end of its inside edge a removable cutting blade having an inside cutting edge facing an inside cutting edge of another cutting blade mounted at the free end of an inside edge of the other one of said two blade supports, said tool further comprising two operating arms hinged together by a common pin and each pivotally connected to a corresponding blade support for pivoting said two blade supports about their respective pivot pins in opposite directions so as to move said two cutting edges towards each other in order to cut a metal member such as a bolt, wherein each blade support comprises two plate-shaped support members which are fastened parallel to each other and between which are disposed said spacer member which is a central spacer member carrying said two pivot pins, a rear central part of said corresponding removable cutting blade carried by said support members and said corresponding operating arm, respectively.

2. A tool as claimed in claim 1 further including two lateral spacer members parallel to said central spacer member, each support member being disposed between said central spacer member and the corresponding lateral spacer member.

3. The tool claimed in claim 1 wherein each cutting blade has on each of its lateral faces a shoulder forming a bearing surface facing towards the rear of said blade and adapted to bear on a corresponding conjugate bearing surface of a respective support member.

4. The tool claimed in claim 3 wherein each cutting blade has between said shoulders a central part extending towards the rear of said blade and adapted to be inserted between the corresponding two support members.

5. The tool claimed in claim 4 wherein each cutting blade is fixed to the corresponding two support members by a pin member passing through two coaxial holes in the respective support members and a hole in the central rear part of said cutting blade, said hole through said central rear part being slightly offset towards the front of said blade relative to said coaxial holes through the respective support members when said shoulders of said blade are in bearing engagement with said bearing surfaces of said two support members and said pin member being a spring pin.

6. The tool claimed in claim 1 wherein each of said two support members of a blade support has on its inside edge a protuberance having a semi-circular convex exterior contour the center of which is located, in the closed position of said tool, and projected into a plane parallel to the surfaces of said support members, at the point where a straight line segment joining the respective pivot pins of said supports intersects the median plane of said pins, and each support member of the other blade support having on its inside edge a semi-circular contour concave notch having in said closed position of said tool the same center as said convex contour and a radius slightly greater than the radius of said convex contour, thereby comprising the equivalent of a rack.

7. The tool claimed in claim 1 wherein each blade has two planes of symmetry perpendicular to each other such that it can be replaced after turning it 180°.

8. The tool claimed in claim 1 wherein each support member has a thickness such that it is adapted to be cut out from a metal plate.

9. The tool claimed in claim 1 wherein each cutting blade is adapted to be cut to length from a bar having a cross-section the shape of said blade.

10. The tool claimed in claim 1, wherein each cutting blade has a wedge-shaped cutting edge extending along the inside edge of the corresponding support members.

* * * * *